US008786526B2

(12) United States Patent
Noguchi

(10) Patent No.: US 8,786,526 B2
(45) Date of Patent: Jul. 22, 2014

(54) ACTIVE MATRIX SUBSTRATE, DISPLAY DEVICE, AND ORGANIC EL DISPLAY DEVICE

(75) Inventor: Noboru Noguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 159 days.

(21) Appl. No.: 13/386,888

(22) PCT Filed: Apr. 2, 2010

(86) PCT No.: PCT/JP2010/056068

§ 371 (c)(1),
(2), (4) Date: Jan. 24, 2012

(87) PCT Pub. No.: WO2011/013409

PCT Pub. Date: Feb. 3, 2011

(65) Prior Publication Data

US 2012/0127220 A1 May 24, 2012

(30) Foreign Application Priority Data

Jul. 28, 2009 (JP) ..... 2009-175702

(51) Int. Cl.
*G09G 3/30* (2006.01)
*G09G 3/32* (2006.01)

(52) U.S. Cl.
CPC ..... *G09G 3/3233* (2013.01); *G09G 2310/0251* (2013.01); *G09G 2300/0819* (2013.01); *G09G 2320/0219* (2013.01); *G09G 2320/0214* (2013.01); *G09G 2310/0262* (2013.01); *G09G 2320/043* (2013.01); *G09G 3/3291* (2013.01); *G09G 2300/0861* (2013.01); *G09G 2320/0252* (2013.01); *G09G 2300/0852* (2013.01)
USPC ..... 345/77

(58) Field of Classification Search
CPC ..... G09G 5/10; G09G 3/30
USPC ..... 345/76, 80, 82, 92
See application file for complete search history.

(56) References Cited

U.S. PATENT DOCUMENTS 5,714,968 A * 2/1998 Ikeda ..... 345/77
6,373,454 B1 4/2002 Knapp et al.
6,384,804 B1 * 5/2002 Dodabalapur et al. ..... 345/82

(Continued)

FOREIGN PATENT DOCUMENTS

JP 2000-347621 A 12/2000
JP 2002-517806 A 6/2002

(Continued)

OTHER PUBLICATIONS

International Search Report received for PCT Patent Application No. PCT/JP2010/056068, mailed on May 18, 2010, 8 pages (4 pages of English Translation and 4 pages of PCT Search Report).

*Primary Examiner* — Pegeman Karimi
(74) *Attorney, Agent, or Firm* — Morrison & Foerster LLP

(57) ABSTRACT

The present invention provides an analog gradation-driving active matrix substrate suppressing reduction in the response time of the current-driven light-emitting element; a display device; and an organic EL display device. The active matrix substrate of the present invention is an analog gradation-driving active matrix substrate, comprising:

pixels each including a current-driven light-emitting element and a drive transistor, the current-driven light-emitting element has a pixel electrode electrically coupled with the drive transistor, the drive transistor supplies a current to the current-driven light-emitting element through the pixel electrode, wherein an adjusting transistor for adjusting a voltage of the pixel electrode is electrically connected to a path for the electric current supplied from the drive transistor to the current-driven light-emitting element.

6 Claims, 9 Drawing Sheets

(56) References Cited

U.S. PATENT DOCUMENTS

| | | | | |
|---|---|---|---|---|
| 6,525,704 | B1 * | 2/2003 | Kondo et al. | 345/78 |
| 2005/0017934 | A1 | 1/2005 | Chung et al. | |
| 2006/0022305 | A1 * | 2/2006 | Yamashita | 257/565 |
| 2006/0108916 | A1 * | 5/2006 | Koo et al. | 313/504 |
| 2006/0125737 | A1 | 6/2006 | Kwak et al. | |
| 2006/0244695 | A1 * | 11/2006 | Komiya | 345/76 |

FOREIGN PATENT DOCUMENTS

| | | | |
|---|---|---|---|
| JP | 2005-31630 | A | 2/2005 |
| JP | 2006-30635 | A | 2/2006 |
| JP | 2006-47999 | A | 2/2006 |
| JP | 2006-146190 | A | 6/2006 |
| JP | 2006-309119 | A | 11/2006 |
| WO | 99/65011 | A2 | 12/1999 |

* cited by examiner

Prior Art

Prior Art

Prior Art

Prior Art

Prior Art

Prior Art

ACTIVE MATRIX SUBSTRATE, DISPLAY DEVICE, AND ORGANIC EL DISPLAY DEVICE

CROSS REFERENCE TO RELATED APPLICATIONS

This application is a U.S. National Phase patent application of PCT/JP2010/056068, filed Apr. 2, 2010, which claims priority to Japanese patent application Serial No. 2009-175702, filed Jul. 28, 2009, each of which is hereby incorporated by reference in the present disclosure in its entirety.

TECHNICAL FIELD

The present invention relates to an active matrix substrate, a display device, and an organic EL display device. More specifically, the present invention relates to an active matrix substrate suitable for display devices that are equipped with current-driven light-emitting elements such as organic EL elements, and a display device and an organic EL display device each including the active matrix substrate.

BACKGROUND ART

There are two modes for driving organic EL display devices, namely, the passive matrix mode and the active matrix mode. The active matrix mode is being the leading mode among the driving modes. This trend is particularly remarkable in the field of large-size display devices.

In general, pixels of active matrix organic EL display devices each have, for each organic EL element, a switching transistor for transmitting data signals and a drive transistor for driving an organic EL element in response to each data signal transmitted by the switching transistor (for example, see Patent Document 1). There occurs parasitic capacitance between these members disposed on each pixel and wiring layers such as a scanning line and a signal line. In order to suppress display failure called crosstalk due to this parasitic capacitance, a method is disclosed in which an electric field pattern is disposed so as to serve as an electric field shield for a scanning line and a signal line (for example, see Patent Document 2).

If the drive transistors of the respective pixels are driven by the same gate voltage even though the drive transistors of the respective pixels have different threshold voltages, current values supplied from the drive transistors to the organic EL elements vary, resulting in non-uniform display. In order to solve this problem, methods are known in which area-gradation expression or time-division-gradation expression is performed based on digital gradation driving. In the case of analog gradation driving, a method is disclosed in which variations in the threshold voltages of the drive transistors are detected and a so-called compensation circuit, which compensates for the variations, is formed in each pixel (for example, see Patent Document 3).

Patent Document 1: JP 2006-47999 A
Patent Document 2: JP 2006-30635 A
Patent Document 3: JP 2005-31630 A

SUMMARY OF THE INVENTION

FIG. 7 is a circuit diagram showing a pixel of a conventional organic EL display device having a compensation circuit. This pixel has six transistors (T1 to T6), two capacitors (C1 and C2), and one organic EL element OLED. In FIG. 7, scan[n−1] and scan[n] indicate the [n−1]th and [n]th scanning lines, respectively; Vini[n] indicates the [n]th voltage-initializing line; and em[n] indicates the [n]th light-emission-controlling line. The transistor T1 causes data signals stored in the capacitors C1 and C2 to be discharged via the voltage-initializing line Vini[n] in response to a scan signal input from the scanning line scan[n−1], and thereby initializes the gate voltage of the transistor T4. The transistor T2 compensates for inaccuracy in the threshold voltage of the transistors T4. The transistor T3 switches on/off data signals input from the signal line data in response to scan signals input from the scanning line scan[n]. The transistor T4 determines the amperage for supplying a current to the organic EL element OLED in response to data signals input through the transistor T3. The transistor T5 switches on/off a current supplied from the power-source line ELVDD to the transistor T4 in response to light-emitting signals input from the light-emission-controlling line em[n]. The transistor T6 switches on/off a current supplied from the transistor T4 to the organic EL element OLED in response to light-emitting signals input from the light-emission-controlling line em[n]. The capacitor C1 stores a gate voltage input to the transistor T4. The capacitor C2 assists the capacitor C1. The organic EL element OLED emits light in response to a current supplied from the transistor T4. The anode of the organic EL element OLED is coupled with a drain of the transistor T6, and the cathode of the organic EL element OLED is coupled with the power-source line ELVSS.

Here, the positional relationship of the respective components of the pixel illustrated in the circuit diagram of FIG. 7 will be described referring to FIGS. 8 and 9. FIG. 8 is a schematic plan view showing the pixel of the conventional organic EL display device having a compensation circuit. FIG. 9 is a schematic cross-sectional view along the X1-X2 line in FIG. 8.

The scanning lines scan[n−1], scan[n], and scan[n+1], the light emission controlling line em[n], and the voltage-initializing line Vini are formed in the same layer (first wiring layer), and they extend in the transverse direction in FIG. 8. In the present description, the state that a layer A and a layer B are in the same layer means that at least the layer A and the layer B are in contact with the same lower layer, or the layer A and the layer B are in contact with the same upper layer. Further, the signal line data is formed in the second wiring layer, and it extends in a longitudinal direction in FIG. 8. In addition, the gate electrode 102 of the transistor T4 and the power-source line ELVDD are formed in both the first wiring layer and the second wiring layer via a contact hole, and they transfer from the first wiring layer to the second wiring layer at a portion overlapping the components such as the scanning lines disposed in the first wiring layer. In FIG. 9, only the portion formed in the second wiring layer of the gate electrode 102 is illustrated. The first wiring layer is disposed as a layer which is closer to a substrate 100 than the second wiring layer.

Each region defined by the scanning line scan[n−1], scanning line scan[n+1], power-source line ELVDD, and signal line data is provided with one pixel electrode 103 serving as an anode of the organic EL element OLED. This region functions as one pixel. On each pixel, the semiconductor layers 101 of the transistors T1 to T6 and the gate electrode 102 of the transistor T4 are disposed. The region represented as A is an opening portion of the pixel region serving as a display region of the organic EL display device.

As shown in FIG. 9, an interlayer insulating layer 110, a first electrode (the portion formed in the first wiring layer of the power-source line ELVDD), an interlayer insulating layer 111, and an interlayer insulating layer 112 are stacked in this order from the substrate 100 side. The semiconductor layer 101 is disposed between the substrate 100 and the interlayer insulating layer 110. The first electrode is disposed between the interlayer insulating layer 110 and the interlayer insulating layer 111. Second electrodes (the gate electrode 102 and the portion formed in the second wiring layer of the power-source line ELVDD) and the signal line data are formed between the interlayer insulating layer 111 and the interlayer insulating layer 112. The pixel electrode 103 is formed on the interlayer insulating layer 112. Edge portions of the pixel electrode 103 are covered with edge covers 113. The edge covers 113 cover the edge periphery of the pixel electrode 103, so that they prevent a short circuit between the pixel electrode 103 and the cathode (power-source line ELVSS) disposed opposite to the pixel electrode 103 via the organic EL layer. A portion in which the edge cover 113 is not formed corresponds to the opening A in FIG. 8.

In the observation about responses between tones in the organic EL display device described referring to FIGS. 7 to 9, the frame (one frame has a display duration of 16.7 ms) immediately after tones are changed does not achieve intended brightness and the following frames achieve the intended brightness; that is, stepwise responses are observed.

FIG. 10 is a graph illustrating the measurement result of the response characteristics of the conventional organic EL display device having a compensation circuit. FIG. 10 shows the result in the case of changing the display from black to white. As shown in FIG. 10, the frame immediately after changing the display from black to white shows very lower brightness than the following frames. This result means that the response time (the time the brightness requires to reach 90% or higher of the brightness to be intrinsically achieved) is longer than the duration of one frame. If the response time is longer than the duration of one frame, unnecessary linear patterns called "caudate afterimage" are visually observed when a displayed material is scrolled (moving images are displayed), resulting in deterioration of display performance. Thus, the conventional organic EL display device having a compensation circuit does not achieve rapid response characteristics which the organic EL element can originally achieve, and therefore can be further improved in the above respect.

The present invention is made under the above situation, and aims to provide an analog gradation-driving active matrix substrate suppressing reduction in the response time of the current-driven light-emitting element; a display device; and an organic EL display device.

The present inventor has performed various studies on an analog gradation-driving active matrix substrate suppressing reduction in the response time of the current-driven light-emitting element, and has focused on the region where the pixel electrode of the current-driven light-emitting element and the gate electrode of the transistor (drive transistor) for driving the current-driven light-emitting element overlap with each other. Since the route of a current supplied from the drive transistor to the current-driven light-emitting element is preferably as short as possible, the current-driven light-emitting element and the drive transistor are disposed close to each other in many cases. Further, in order to form the light-emitting region as large as possible, the area ratio of the pixel electrode is set large, in general. Because of these reasons, the pixel electrode of the current-driven light-emitting element and the gate electrode of the drive transistor are disposed in an overlapping manner in many cases, and thus parasitic capacitance is likely to occur. Especially in the case of the pixel having a compensation circuit, many components are disposed in the pixel and the layout of the components is complicated. Thus, the region where the pixel electrode of the current-driven light-emitting element overlaps the gate electrode of the drive transistor is likely to be large. In the case that the compensation circuit comprises multiple transistors as in the organic EL display device shown in FIGS. 7 to 9, the pixel electrode of the current-driven light-emitting element may cover the whole of the gate electrode of the drive transistor. In the organic EL display device shown in FIGS. 7 to 9, parasitic capacitance (hereinafter, referred to as Cad) occurs between the gate electrode 102 of the transistor T4 (drive transistor) and the pixel electrode 103 (anode) of the organic EL element OLED. The present inventor has considered that this Cad caused the stepwise responses in the measurement result shown in FIG. 10.

In order to confirm the above study results, the simulations about response waveforms at different Cads were performed on the organic EL display device shown in FIGS. 7 to 9. FIGS. 11, 12, and 13 are graphs of the response waveforms of currents obtained in the simulations of response waveforms wherein the Cads are 0, 20, and 60 fF, respectively.

As shown in FIGS. 11 to 13, no stepwise responses were observed at a Cad of 0 fF, while stepwise responses were observed at a Cad of 20 and 60 fF. The regions defined by dot lines in FIGS. 12 and 13 indicate the portions where stepwise responses occur. Further, the graphs show that the difference between the current value of the first frame and the current value of the second frame becomes greater as the Cad increases from 20 fF to 60 fF.

Based on the results of the simulations for the response waveforms, the relationship between a current supplied to the organic EL element and a Cad is evaluated. FIG. 14 is a graph showing the relationship between a current supplied to the organic EL element and a Cad. FIG. 14 also reflects the results of the simulations wherein the Cad is set to a value except 0, 20, and 60 fF. In FIG. 14, the "current ratio" on the vertical axis means a ratio between the current of the first frame and that of the third frame after the display is changed from black to white or a middle tone, and is a value obtained by dividing the average current value of the first frame by the average current value of the third frame.

The results shown in FIG. 14 prove that the current ratio tends to become small as the Cad increases. In other words, an increase in the Cad tends to cause an increase in the difference between the current of the first frame and the current of the third frame.

The brightness of the organic EL element is proportional to the current supplied from the drive transistor. In other words, the current ratio in FIG. 14 is equal to the ratio between the brightness of the first frame and that of the third frame. Thus, in order to make the response time shorter than the duration of one frame and to prevent occurrence of the stepwise response characteristics, the current ratio in FIG. 14 is required to be higher than 0.9. Based on the results shown in FIG. 14, the current ratio excesses 0.9 probably when the display is switched from black to white at a Cad of substantially lower than 20 fF, and probably when the display is switched from black to a middle tone at a Cad of substantially lower than 16 fF. In the organic EL display device shown in FIGS. 7 to 9, however, the current ratio is not higher than 0.9 and the response time is longer than the duration of one frame, as shown in FIG. 10.

The following will describe a method of driving the pixel shown in FIG. 7 and the reason why stepwise responses occur due to Cad. FIG. 15 is a timing chart at the first frame of the pixel shown in FIG. 7. In FIG. 15, displacement in the vertical direction indicates the change in a voltage of each wiring, while the lapse of time is presented from left to right. FIG. 15 is drawn in such a manner that the respective wirings vertically arranged are on the same horizontal time axis so that the voltages of the wirings at the same timing are easily compared. Further, in FIG. 15, Vgs indicates the gate voltage of the transistor T4.

In one frame, three periods: initializing period a, programming period b, and light-emitting period c, are contained in this order. The respective periods will be described hereinbelow.

First, in the initializing period a, the scanning line scan[n−1] is switched on, and an electric charge (data signal) stored in the capacitors C1 and C2 are discharged through the voltage-initializing line Vini[n]. As a result, the gate voltage of the transistor T4 is initialized.

Next, in the programming period b, the scanning line scan [n] is switched on, and the data of the tone input from the signal line data is written on the transistor T4. Thereby, the threshold voltage of the transistor T4 is compensated. At this time, the gate voltage of the transistor T4 is lower than the voltage (Vdata) input from the signal line data by the value equivalent to the threshold voltage (Vth) of the transistor T4. Further, an electric charge corresponding to the gate voltage of the transistor T4 is also stored in the capacitors C1 and C2.

Then, in the light-emitting period c, the light emission controlling line em[n] is switched on, and the current corresponding to the gate voltage of the transistor T4, that is, Vdata−Vth, is supplied to the organic EL element OLED. Thereby, the organic EL element OLED emits light.

The following will describe the relationship between the gate voltage of the transistor T4 and the current supplied from the transistor T4 to the organic EL element OLED. FIG. 16 is a schematic view showing the TFT characteristics of the transistor T4 (drive transistor). In FIG. 16, V8 (V) and V255 (V) indicate gate voltages (Vgs) of the transistor T4 at the 8th tone and the 255th tone, respectively.

In the programming period b, the threshold voltage of the transistor T4 is compensated, and the value Vdata−Vth is set to the gate voltage of the transistor T4.

In the light-emitting period c, a current corresponding to the gate voltage of the transistor T4 is applied. When Vdata_1<Vdata_2, the gate voltage (Vgs) of the transistor T4 upon light emission indicates Vgs_1<Vgs_2. In other words, the gate voltage (Vgs) of the transistor T4 increases as a voltage (Vdata) input from the signal line data increases. As a result, the current value (Ids) becomes small. In the TFT characteristics shown in FIG. 16, Vgs_1 corresponds to V255 (V), and Vgs_2 corresponds to V8 (V).

The following will describe the reason why the Cad causes stepwise responses. When the light emission controlling line em[n] is switched on during the light-emitting period c in FIG. 15, the gate voltage (Vgs) of the transistor T4 rises by the width represented as a. This is presumably due to the capacity component of the organic EL element OLED itself. As the electric charge of the pixel electrode of the organic EL element OLED is not sufficiently removed during the period of displaying no image (the period during which the light emission controlling line em[n] is switched off), the Vgs of the transistor T4 is pushed up toward the direction of the voltage of the previous frame via the Cad, and the gate voltage (Vgs) of the transistor T4 shows a voltage different from its predetermined voltage when the light emission controlling line em[n] is switched on.

In contrast, in the following frames, the electric potential of the pixel electrode of the organic EL element OLED is an electric potential obtained by adding the pushed-up (or pushed-down) electric potential to the predetermined electric potential. Thus, the gate voltage (Vgs) of the transistor T4 is less likely to be affected by the previous frame than the first frame after tone switching, and shows a voltage closer to the predetermined gate voltage. As a result, the first frame and the next frame after tone switching show stepwise-response characteristics.

Therefore, in order to remove the stepwise-response characteristics, the Cad is required to be reduced. The Cad can be reduced by reducing the difference between the voltage of the pixel electrode of the organic EL element OLED and the gate voltage of the drive transistor. The present inventor has further made various investigations, and has noted that the difference between the voltage of the pixel electrode of the organic EL element OLED and the gate voltage of the drive transistor can be reduced by providing a new adjusting transistor for adjusting a voltage of the pixel electrode. Thereby, the Cad is reduced and occurrence of the stepwise response characteristics can be prevented. Thus, the above problems were solved, leading to completion of the present invention.

That is, the present invention is an analog gradation-driving active matrix substrate, comprising:

pixels each including a current-driven light-emitting element and a drive transistor, the current-driven light-emitting element has a pixel electrode electrically coupled with the drive transistor, the drive transistor supplies a current to the current-driven light-emitting element through the pixel electrode, wherein an adjusting transistor for adjusting a voltage of the pixel electrode is electrically connected to a path for the electric current supplied from the drive transistor to the current-driven light-emitting element.

The configuration of the active matrix substrate of the present invention is not particularly limited as long as it essentially includes such components. The active matrix substrate may or may not include other components. Preferable embodiments of the active matrix substrate of the present invention are described in detail below.

One preferred embodiment of the active matrix substrate of the present invention is one wherein a signal line to which a source electrode or a drain electrode of the adjusting transistor is electrically connected is different from a signal line to which a source electrode or a drain electrode of the drive transistor is electrically connected. In such an embodiment, different data signals are fed to the adjusting transistor and the drive transistor. Therefore, the pixel electrode can be adjusted to have an optimal voltage. In other words, in such an embodiment, data signals are fed from different signal lines to the adjusting transistor and the drive transistor. As used herein, "the optimal voltage" refers to the same voltage as a gate voltage of the drive transistor. For example, in the pixel shown in FIG. 7, the transistor T4 at the time of compensation of a threshold is a diode-connected transistor. Therefore, the gate voltage of the transistor T4 is determined by subtracting a threshold voltage Vth of the transistor T4 from the voltage Vdata fed from the signal line data. Therefore, in this case "the optimal voltage" is "Vdata−Vth". Thus, when the voltage of the pixel electrode is made to be the same as the gate voltage of the drive transistor by adjusting the voltage of the pixel electrode using the adjusting transistor, the Cad can be eliminated and effects of the preceding frame can be eliminated. As a result, occurrence of the stepwise response characteristics can be prevented. When the adjusting transistor is a Pch transistor, an electrode connected to the signal line is the source electrode, and when the adjusting transistor is an Nch transistor, an electrode connected to the signal line is the drain electrode. The same applies to the drive transistor.

One preferred embodiment of the active matrix substrate of the present invention is one wherein a signal line to which a source electrode or a drain electrode of the adjusting transistor is electrically connected is the same as a signal line to which a source electrode or a drain electrode of the drive transistor is electrically connected. In other words, in such an embodiment, data signals are fed from the same signal line to the adjusting transistor and the drive transistor. According to the embodiment, the voltage of the pixel electrode is adjusted using the adjusting transistor, thereby the voltage of the pixel electrode can be close to the gate voltage of the drive transistor. Therefore, the Cad can be reduced and effects of the preceding frame can be suppressed. As a result, occurrence of the stepwise response characteristics can be suppressed. In such an embodiment where the same data signal is fed to the adjusting transistor and the drive transistor, an optimal voltage may not be fed to the pixel electrode. For example, in the pixel shown in FIG. 7, the transistor T4 (drive transistor) is a diode-connected transistor for compensating a threshold voltage thereof. In such a case, the gate voltage of the transistor T4 is Vdata−Vth, and on the other hand, the voltage of the pixel electrode adjusted using the adjusting transistor is Vdata. Therefore, the difference between the voltage of the pixel electrode and the gate voltage of the drive transistor is Vth. The Cad may be generated due to the difference. However, the value of Vth is adjustable in the process for TFTs and is sufficiently small compared to amplitude of Vdata. Therefore, also in such an embodiment, the Cad can be reduced and the effect of suppressing occurrence of the stepwise response characteristics is sufficiently exhibited. When the adjusting transistor is a Pch transistor, an electrode connected to the signal line is the source electrode. When the adjusting transistor is an Nch transistor, an electrode connected to the signal line is the drain electrode. The same applies to the drive transistor.

The source electrode or the drain electrode of the adjusting transistor, and the source electrode or the drain electrode of the drive transistor may be electrically connected to a signal line. They may be connected to the signal line directly or may be connected to the signal line through another transistor.

One preferred embodiment of the active matrix substrate of the present invention is one wherein a source electrode and a drain electrode of the adjusting transistor are connected in parallel to the current-driven light-emitting element. The current-driven light-emitting element usually has a light-emitting body and an electrode (hereinafter, referred to as a counter electrode) which faces a pixel electrode. The light-emitting body is disposed between the counter electrode and the pixel electrode. According to such a configuration, the voltage of the pixel electrode can be the same as that of the counter electrode. This enables discharge of charge stored in the Cad from the counter electrode side, using the adjusting transistor as a path for electric current. As a result, effects of the preceding frame can be eliminated and occurrence of the stepwise response characteristics can be prevented.

The Cad increases as the distance between the gate electrode of the drive transistor and the pixel electrode of the current-driven light-emitting element is decreased. Therefore, particularly when a gate electrode of the drive transistor is provided in a wiring layer which is disposed directly below the pixel electrode of the current-driven light-emitting element, the Cad tends to increase. In such a case where the gate electrode of the drive transistor is provided in a wiring layer which is disposed directly below the pixel electrode, the present invention is particularly effective.

When the pixel further includes a compensation circuit for compensating variation of a threshold voltage of the drive transistor, the number of the components provided in the pixel increases. Therefore, the degree of freedom of the layout adjustment in the pixel becomes small. When the layout of the pixel becomes complicated, an area in which a pixel electrode of the current-driven light-emitting element overlaps the gate electrode of the drive transistor tends to increase. In such a case where the pixel further includes a compensation circuit for compensating variation of a threshold voltage of the drive transistor, the present invention is particularly effective.

As described using FIGS. 8 and 9, the gate electrode (gate electrode 102) of the drive transistor is generally formed in both the first wiring layer and the second wiring layer via a contact hole, and the gate electrode 102 transfers from the first wiring layer to the second wiring layer at a portion overlapping the components such as the scanning lines disposed in the first wiring layer. When the organic EL display device includes a compensation circuit having a plurality of transistors, as shown in FIGS. 7 to 9, the layout of the pixel becomes complicated. Therefore, the gate electrode 102 is likely to overlap the scanning lines formed in the first wiring layer, and the like. In such a case, the area of the gate electrode 102 provided in the second wiring layer (a wiring layer directly below the pixel electrode 103) increases. Therefore, the Cad tends to increase. According to the present invention, the Cad can be reduced, and therefore, the subject in the embodiment can be effectively solved. That is, the present invention is particularly effective when the compensation circuit includes a plurality of transistors.

The present invention also includes a display device, comprising the active matrix substrate of the present invention, the display device allowing the current-driven light-emitting element to emit light after voltage adjustment of the pixel electrode by the adjusting transistor. This enables to perform a light-emitting period in a state where the voltage of the pixel electrode is adjusted by a voltage adjusting period. Therefore, the influence of a preceding frame on a gate voltage of the drive transistor can be reduced, and occurrence of the stepwise response characteristics can be suppressed. As a result, a display device excellent in display performance can be achieved.

It is preferred that the voltage adjustment and the light emission are sequentially performed. Thereby, an current-driven light-emitting element is allowed to emit light immediately after the voltage of the pixel electrode is adjusted. Therefore, the change in voltage of the pixel electrode adjusted using the adjustment transistor can be suppressed.

The present invention also includes an organic EL display device, comprising the active matrix substrate of the present invention, the current-driven light-emitting element being an organic EL element, the pixel electrode being an anode or a cathode of the organic EL element. According to the active matrix substrate of the present invention, the Cad is reduced and occurrence of the stepwise response characteristics is suppressed. Therefore, the organic EL display device excellent in display performance can be achieved.

The embodiments described above may be appropriately combined with each other without departing from the scope of the present invention.

Effects of the Invention

According to the active matrix substrate, display device, and organic EL display device, of the present invention, an analog gradation-driving active matrix substrate, a display device, and an organic EL display device, in which reduction in response speed of a current-driven light-emitting element is suppressed, can be achieved.

MODES FOR CARRYING OUT THE INVENTION

The term "pixel electrode" herein means an electrode electrically coupled with a drain electrode of the drive transistor among the electrodes of the current-driven light-emitting element. In the case of the organic EL element, the pixel electrode may be an anode or may be a cathode.

The term "current-driven light-emitting element" herein means any element which is self-luminous depending on a supplied current, and is not particularly limited. Examples of those particularly effectively used in the present invention include flat-shaped current-driven light-emitting elements such as organic EL elements and inorganic EL elements.

The term "wiring layer directly under the pixel electrode" herein means the first wiring layer from the pixel electrode among the wiring layers which are disposed closer to the substrate than the pixel electrode is. In general, an interlayer insulating layer is disposed between the pixel electrode and the wiring layer. Thus, the "wiring layer directly under the pixel electrode" is also referred to as the "wiring layer adjacent to the pixel electrode via the interlayer insulating layer".

Figure 7:
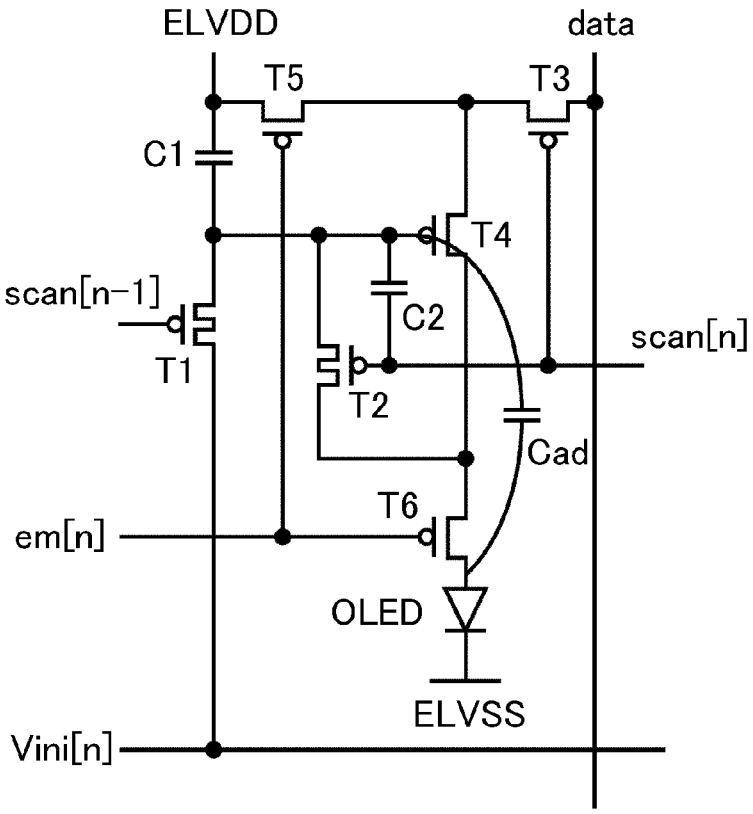
FIG. 7 shows a circuit diagram of a pixel of a conventional organic EL display device including a compensation circuit.
Figure 8:
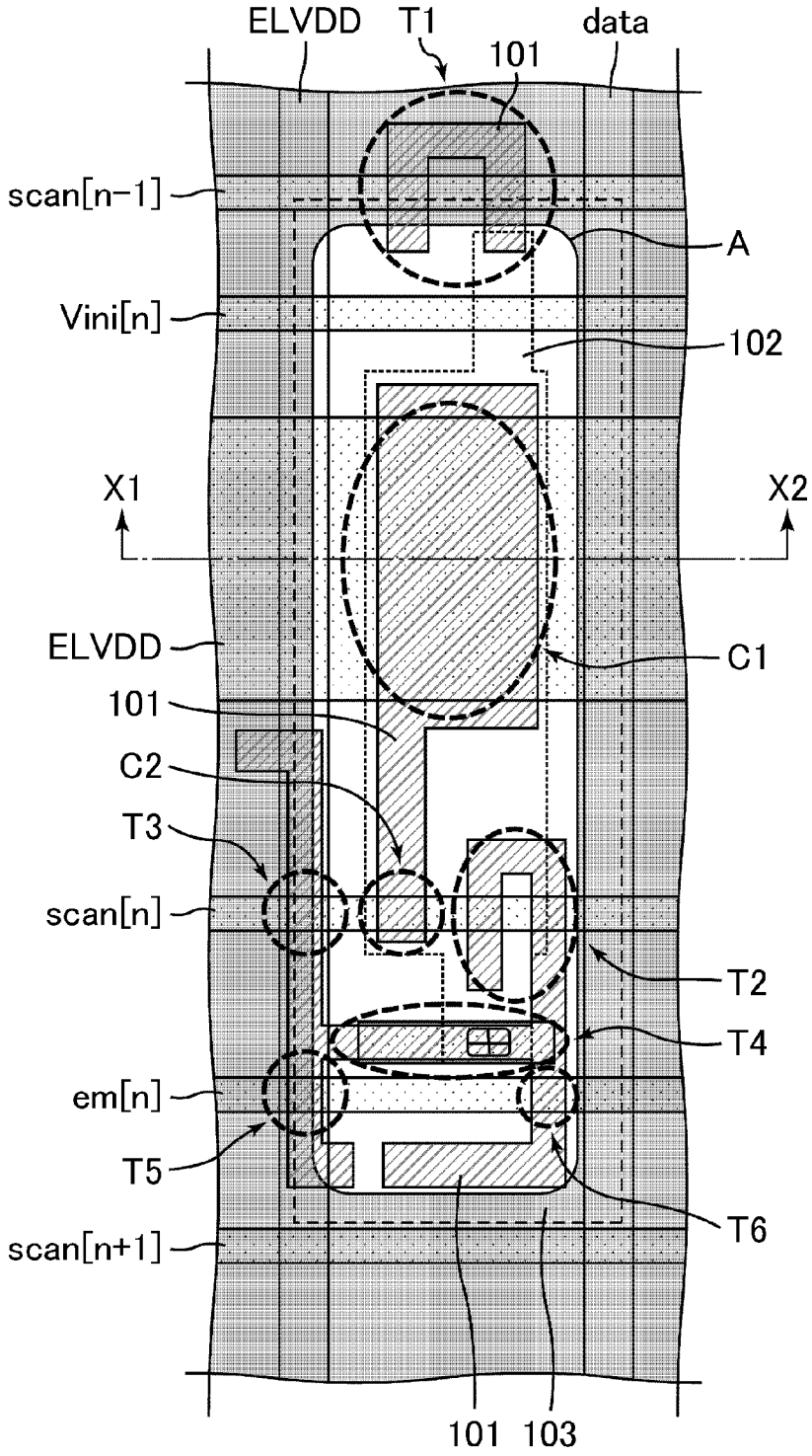
FIG. 8 shows a plane schematic view of a pixel of a conventional organic EL display device including a compensation circuit.
Figure 9:
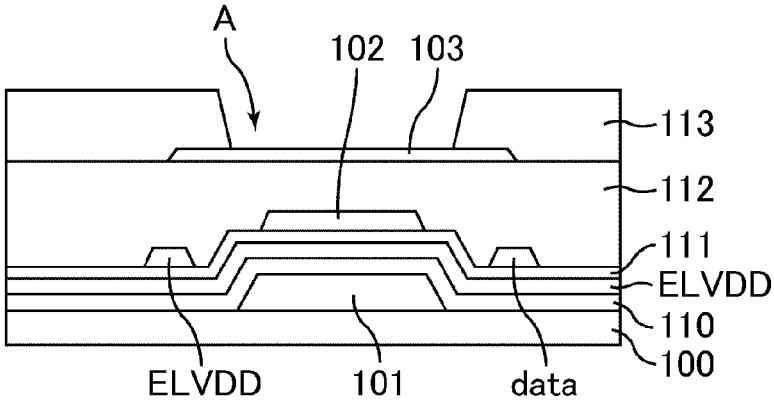
FIG. 9 shows a cross-sectional schematic view taken along the line X1-X2 in FIG. 8.
Figure 10:
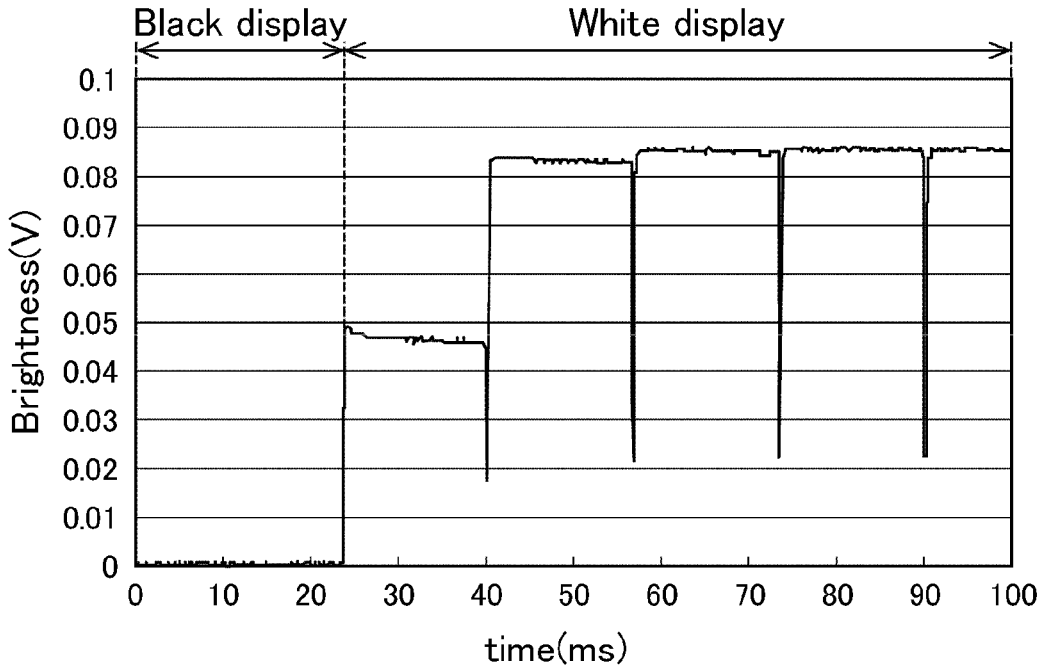
Prior Art Fig. 10
FIG. 10 shows a graph of measurement results of response characteristics of a conventional organic EL display device including a compensation circuit.
Figure 11:
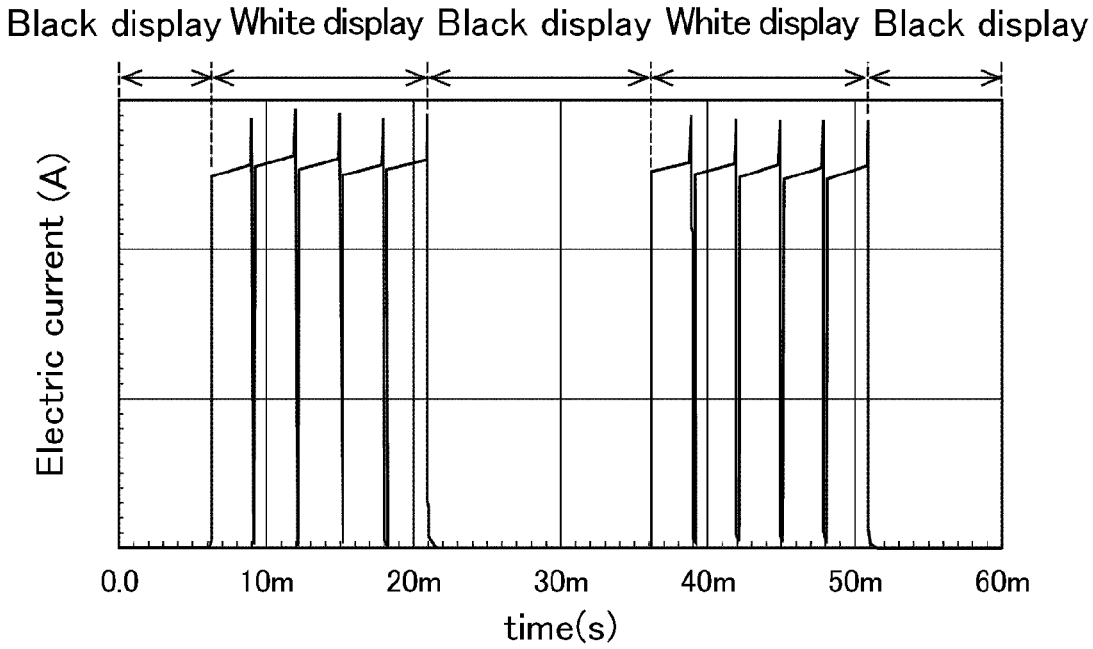
FIG. 11 shows a graph of a response waveform of electric current obtained by simulation of a response waveform when Cad is 0 fF.
Figure 12:
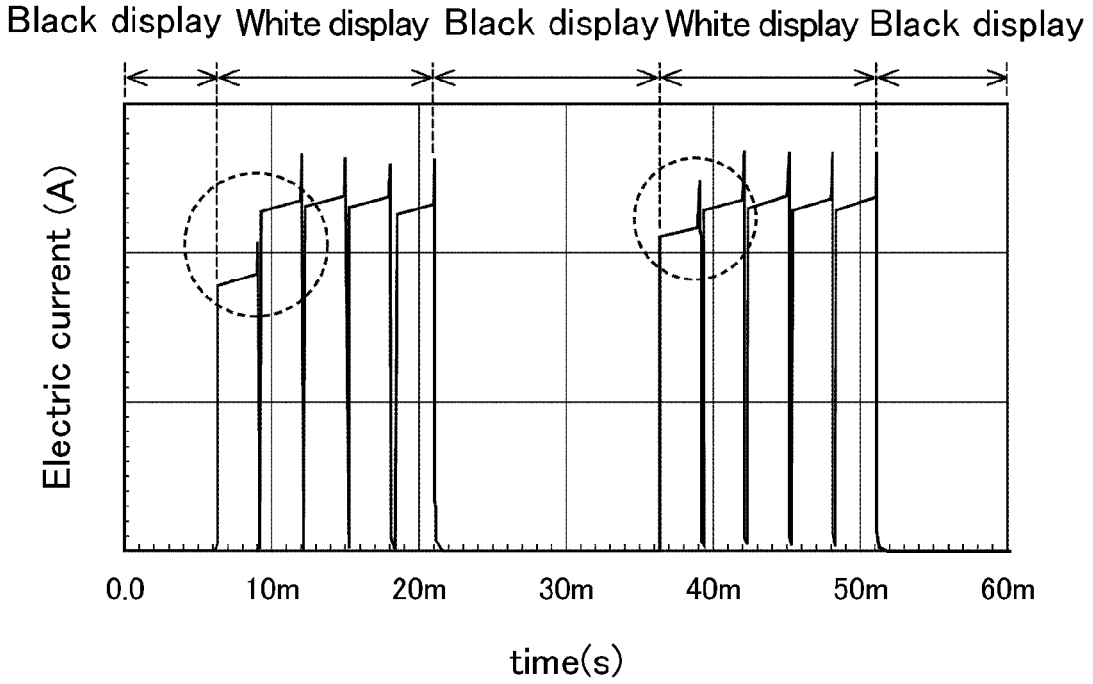
Prior Art Fig. 12
FIG. 12 shows a graph of a response waveform of electric current obtained by simulation of a response waveform when Cad is 20 fF.
Figure 13:
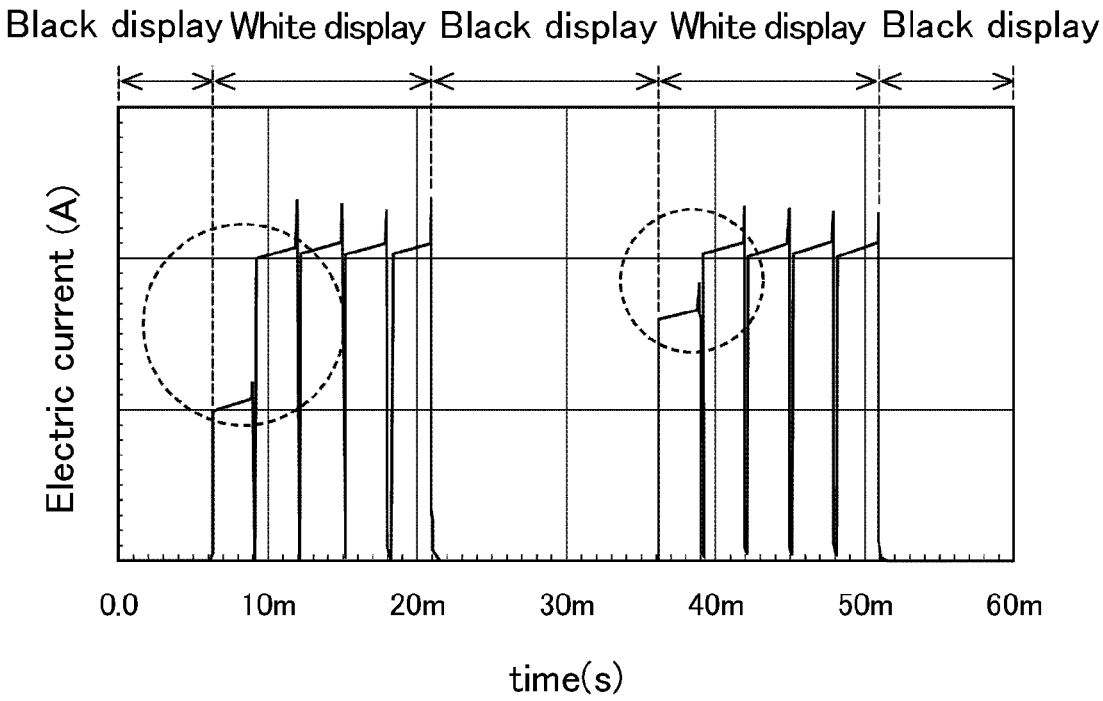
FIG. 13 shows a graph of a response waveform of electric current obtained by simulation of a response waveform when Cad is 60 fF.
Figure 14:
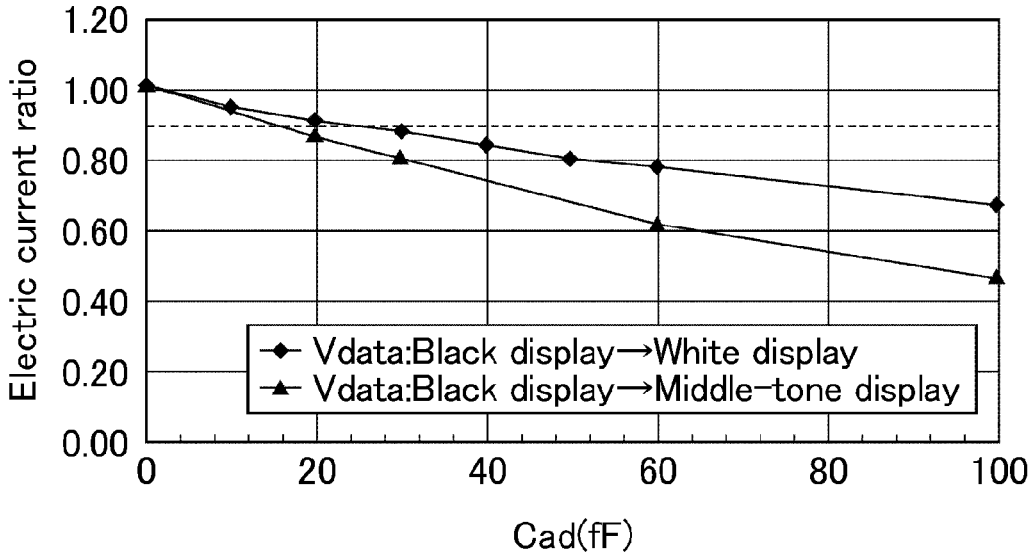
Prior Art Fig. 14
FIG. 14 shows a graph of the relation between electric current supplied to an organic EL element and Cad.
Figure 15:
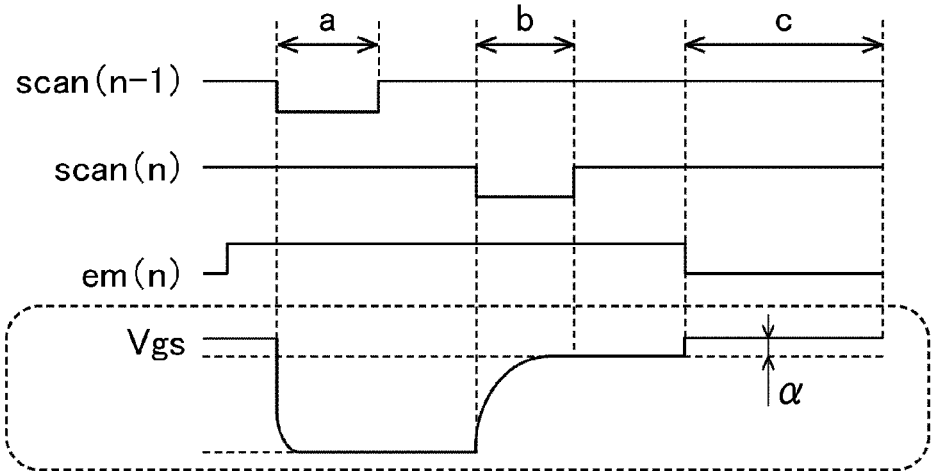
FIG. 15 shows a timing chart of a first frame of a pixel shown in FIG. 7.
Figure 16:
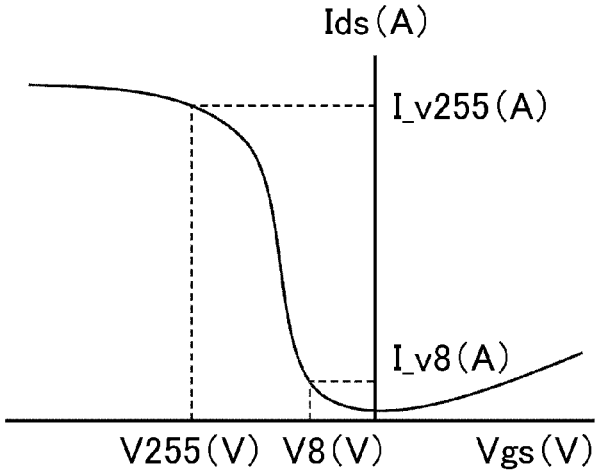
Prior Art Fig. 16
FIG. 16 shows a schematic view of TFT characteristics of a transistor T4 (drive transistor).

The present invention will be mentioned in more detail referring to the drawings in the following embodiments, but is not limited to these embodiments. The following embodiments will be described referring to the case where the present invention is applied to the organic EL display device shown in FIGS. 7 to 9 in order to simplify the description.

Embodiment 1

Figure 1:
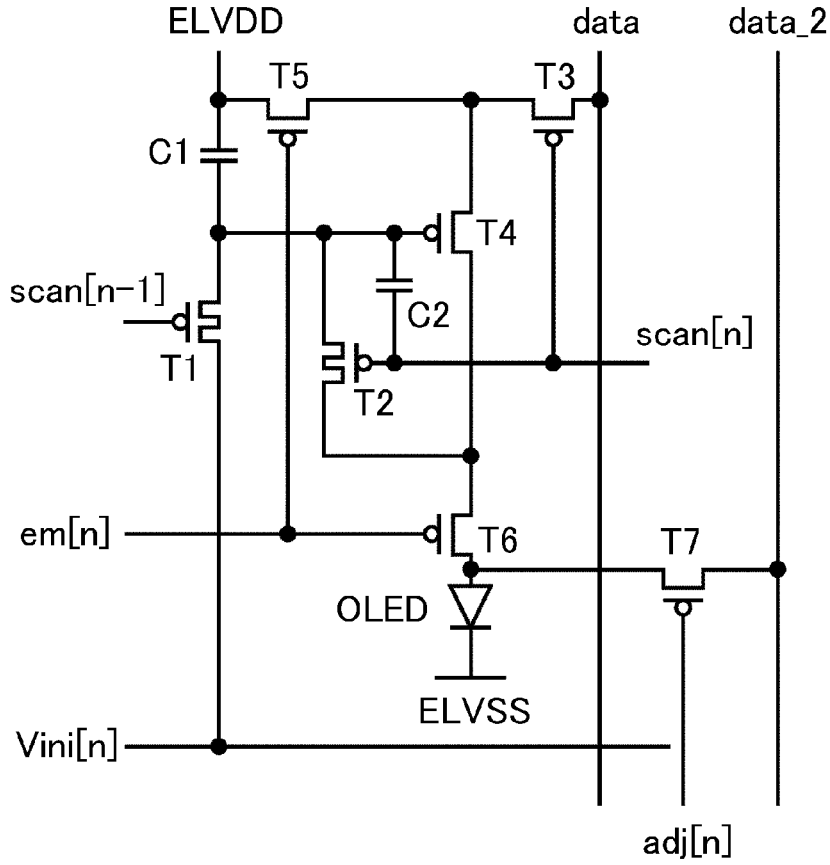
FIG. 1 shows a circuit diagram of a pixel of an organic EL display device of embodiment 1.

FIG. 1 shows a circuit diagram of a pixel of an organic EL display device of embodiment 1. As shown in FIG. 1, a pixel of an organic EL display device of the present embodiment includes a transistor T7 as an adjusting transistor for adjusting the voltage of a pixel electrode of an organic EL element OLED. The transistor T7 is electrically connected to a path used for supplying electric current to the organic EL element OLED from the transistor T4 (drive transistor). More specifically, the drain electrode of the transistor T7 is electrically connected to the path for supplying electric current to the organic EL element OLED from the transistor T4. The source electrode of the transistor T7 is electrically connected to a signal line "data_2". A voltage adjusting line adj [n] is electrically connected to the gate electrode of the transistor T7. At the path for supplying electric current to the organic EL element OLED from the transistor T4, a transistor T6 for switching of the electric current supplied to the organic EL element OLED is provided. The drain electrode of the transistor T7 is electrically connected to the drain electrode of the transistor T6.

Figure 2:
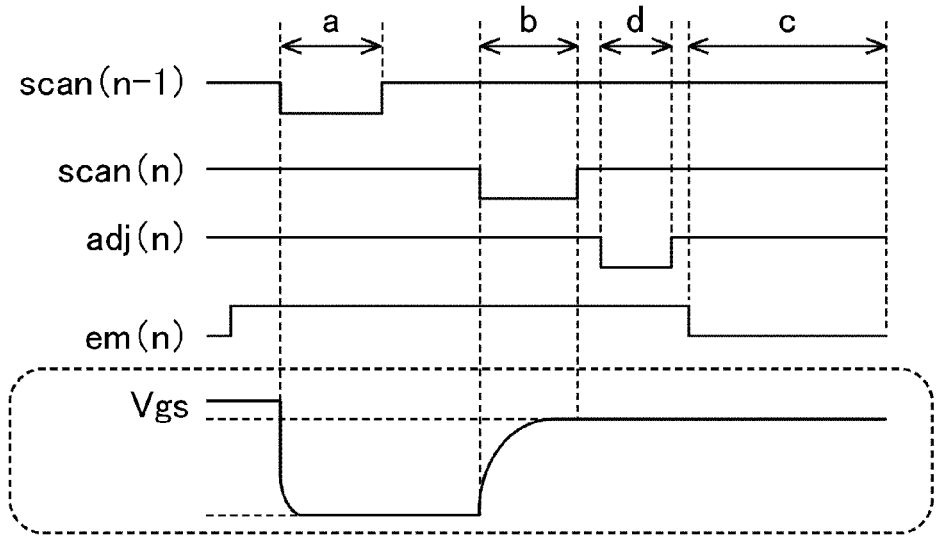
FIG. 2 shows a timing chart of a first frame of a pixel of an organic EL display device of embodiment 1.

The method for driving a pixel of the organic EL display device of the present embodiment is described below. FIG. 2 shows a timing chart of a first frame of a pixel of an organic EL display device of embodiment 1. In FIG. 2, displacement in a longitudinal direction represents change in voltage of each of wirings, and time goes from left to right. In FIG. 2, in order to easily compare voltages of each of wirings at the same time, timing charts are arranged in a longitudinal direction so as to be identical to one another in terms of time. Further, in FIG. 2, Vgs shows a gate voltage of the transistor T4.

As shown in FIG. 2, in the organic EL display device of embodiment 1, one frame includes an initiating period a, a program period b, an adjusting period d, and a light-emitting period c, in this order. That is, the voltage adjustment of the pixel electrode and the light emission of the organic EL element OLED are sequentially performed.

In the adjusting period d, the voltage adjusting line adj [n] is switched to the ON state, and then a data signal from a signal line "data_2" is written as the pixel electrode of the organic EL element OLED through the transistor T7. Thereby, the voltage of the pixel electrode of the organic EL element OLED is adjusted. At this time, the voltage of the pixel electrode has a value of the data signal fed from the signal line "data_2".

In the organic EL display device of the present embodiment, the source electrode of the transistor T7 is electrically connected to the signal line "data_2", and the source electrode of the transistor T4 is electrically connected to the signal line data. That is, the signal line to which the source electrode of the transistor T7 (adjusting transistor) is electrically connected is different from the signal line to which the source electrode of the transistor T4 (drive transistor) is electrically connected. Thereby, the data signal fed into the signal line "data" is allowed to be different from that fed into the signal line "data_2". As a result, the pixel electrode of the organic EL element OLED has an optimal voltage. In the present embodiment, "optimal voltage" is a voltage (Vdata−Vth) which is written as the gate voltage of the transistor T4. That is, in the present embodiment, the data signal fed from the signal line "data_2" is set so that the value of the data signal is lower than the data signal fed from the signal line "data" by the value corresponding to Vth. In the case where the voltage of the pixel electrode of the organic EL element is the same as the gate voltage of the transistor T4, the Cad can be eliminated and effects of the preceding frame can be eliminated. As a result, display characteristics without occurrence of the stepwise response characteristics can be achieved.

In the organic EL display device of the present embodiment, one frame includes an initiating period a, a program period b, an adjusting period d, and a light-emitting period c, in this order. The voltage adjustment of the pixel electrode and the light emission of the organic EL element OLED are sequentially performed. Thereby, the voltage of the pixel electrode can be adjusted just before the light-emitting period c. Therefore, change in voltage of the pixel electrode adjusted by the transistor T7 can be suppressed.

The voltage adjustment of the pixel electrode and the light emission of the organic EL element OLED are not necessarily sequentially performed. The adjusting period d may be provided before the program period b. In this case, the voltage of the pixel electrode adjusted in the adjusting period d may be changed in the program period b. However, even if the voltage of the pixel electrode has some changes, the voltage of the pixel electrode can be close to the gate voltage of the transistor T4, compared to the conventional embodiment shown in FIGS. 7 to 9. Therefore, the effects of the preceding frame on the gate voltage of the transistor T4 can be reduced.

Figure 3:
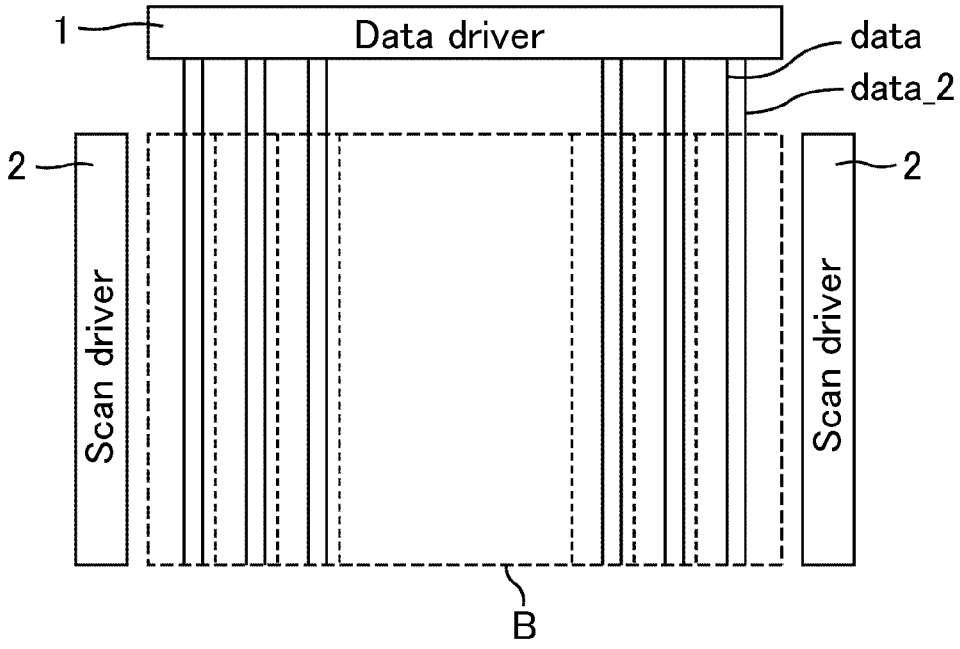
FIG. 3 shows a schematic view of an example of a structure of a display panel included in an organic EL display device of embodiment 1.
Figure 4:
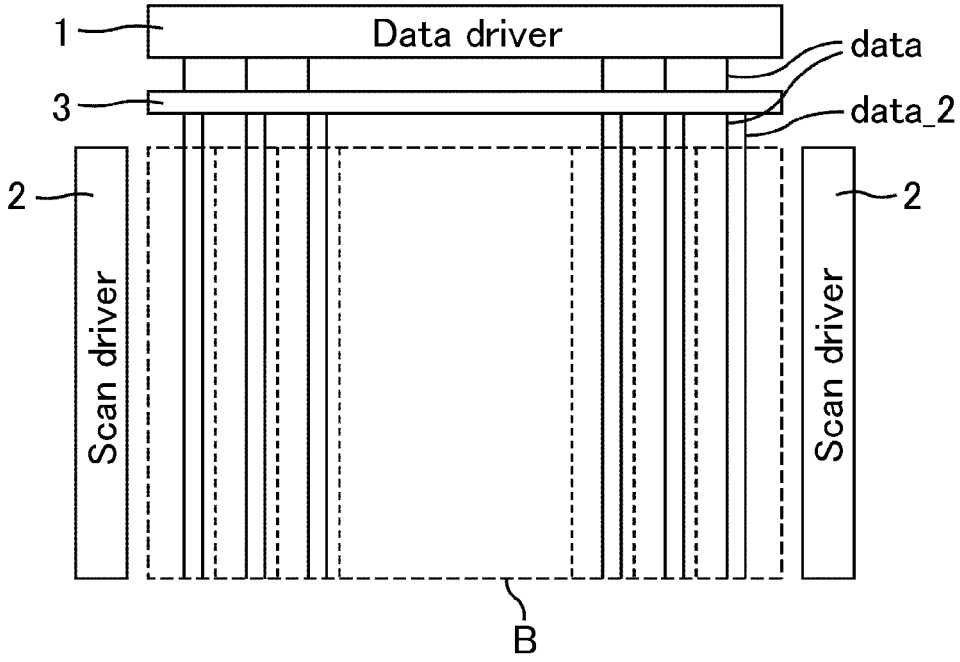
FIG. 4 shows a schematic view of an example of a structure of a display panel included in an organic EL display device of embodiment 1.

A method for feeding a data signal to the signal line "data" and the signal line "data_2" is not particularly limited, and a general method may be used as the method. The example of the method for feeding a data signal to the signal line "data" and the signal line "data_2" is described below with reference to figures. FIGS. 3 and 4 each show a schematic view of a structural example of a display panel included in an organic EL display device of embodiment 1. In order for FIGS. 3 and 4 to clearly show the components, the wirings shown in the figures are only a signal line "data" and a signal line "data_2". The display panel actually includes other lines such as scanning lines and power supply lines. The scanning lines are electrically connected to scan drivers 2. In FIGS. 3 and 4, the area indicated by B shows a display area of the display panel.

In the structural embodiment shown in FIG. 3, both the signal line "data" and the signal line "data_2" are electrically connected to a data driver 1. In this case, the data driver 1 supplies two kinds of data signals. Specifically, the data driver 1 preliminarily calculates a threshold voltage (Vth) of the transistor T4, and sets the data signal fed into the signal line "data_2" so that the value of the data signal is lower than the data signal fed into the signal line "data" by the value corresponding to Vth. Thus, the data signal fed into the signal line "data" is allowed to be different into that fed into the signal line "data_2".

In an example of the structure shown in FIG. 4, only the signal line "data" is electrically connected to the data driver 1, and both the signal line "data" and the signal line "data_2" are electrically connected to a data signal transducer 3. The data driver 1 supplies one kind of data signal. The data signal transducer 3 preliminarily calculates a threshold voltage (Vth) of the transistor T4, and sets the data signal fed into the signal line "data_2" so that the value of the data signal is lower than the data signal fed into the signal line data by the value corresponding to Vth. Thus, the data signal fed into the signal line "data" is allowed to be different from that fed into the signal line "data_2".

The method described using FIGS. 3 and 4 is just one example of a method for feeding different data signals to the signal line "data" and the signal line "data_2". Other methods may be used for feeding different data signals to the signal line "data" and the signal line "data_2".

Embodiment 2

Figure 5:
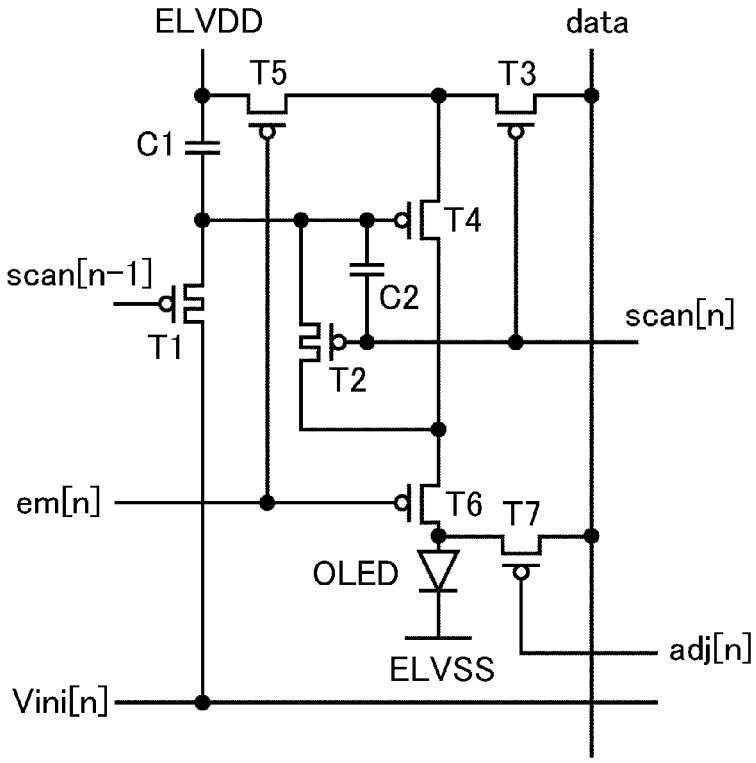
FIG. 5 shows a circuit diagram of a pixel of an organic EL display device of embodiment 2.

FIG. 5 shows a circuit diagram of a pixel of an organic EL display device of embodiment 2. As shown in FIG. 5, the organic EL display device of embodiment 2 includes no signal line "data_2". A source electrode of a transistor T7 is electrically connected to a signal line data. That is, the organic EL display device of embodiment 2 has the same structure as that of embodiment 1 except that the signal line to which the source electrode of the transistor T7 (adjusting transistor) is electrically connected is the same as the signal line to which the source electrode of the transistor T4 (drive transistor) is electrically connected.

In the organic EL display device of the present embodiment, the signal line to which the source electrode of the transistor T7 is electrically connected is the same as the signal line to which the source electrode of the transistor T4 is electrically connected. Therefore, the voltage of the pixel electrode adjusted by the transistor T7 is the same as the voltage of the data signal (Vdata) fed from the signal line data. The gate voltage of the transistor T4 is Vdata−Vth. Therefore, Cad corresponding to the amount of the voltage difference of Vth is generated between the pixel electrode and the gate electrode of the drive transistor. However, the value of Vth is adjustable in the process for TFTs and can be made sufficiently small compared to amplitude of Vdata. Therefore, also in such an embodiment, the Cad can be reduced and the effect of suppressing occurrence of the stepwise response characteristics is sufficiently exhibited. The feeding of signals to respective wirings may be performed at the same timing as that of embodiment 1. Therefore, the timing chart showing operation of the pixels of the organic EL display device of the present embodiment is the same as that of embodiment 1.

Embodiment 3

Figure 6:
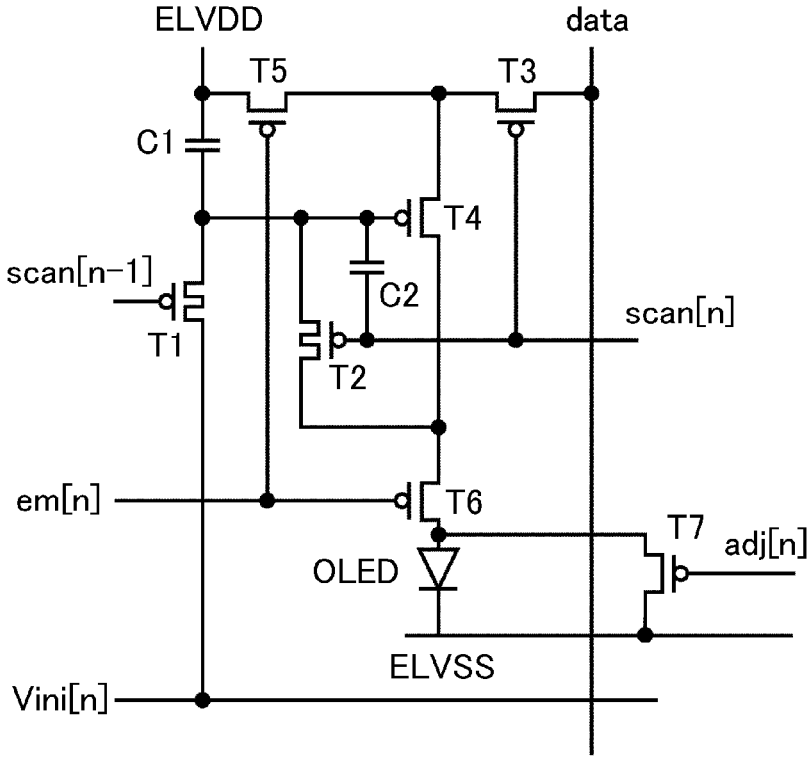
FIG. 6 shows a circuit diagram of a pixel of an organic EL display device of embodiment 3.

FIG. 6 shows a circuit diagram of a pixel of an organic EL display device of embodiment 3. As shown in FIG. 6, the organic EL display device of embodiment 3 has the same structure as that of embodiment 1 except that no signal line "data_2" is provided and the source electrode and a drain electrode of the transistor T7 are connected in parallel to the organic EL element OLED.

In the organic EL display device of the present embodiment, the source electrode and the drain electrode of the transistor T7 are connected in parallel to the organic EL element OLED. Therefore, the voltages of the anode and cathode of the organic EL element OLED may be the same as each other. This enables discharge of charge, which is stored in the Cad, through a power supply line ELVSS using the transistor T7 as a path for electric current. As a result, display characteristics without occurrence of the stepwise response characteristics can be achieved. The feeding of signals into respective wirings may be performed at the same timing as that of embodiment 1. Therefore, the timing chart showing operation of the pixel of the organic EL display device of the present embodiment is the same as that of embodiment 1.

In embodiments 1 to 3, the case where the transistor T7 is a Pch transistor is described. However, the transistor T7 may be an Nch transistor.

The embodiments described above may be appropriately combined with each other without departing from the scope of the invention.

The present application claims priority to Patent Application No. 2009-175702 filed in Japan on Jul. 28, 2009 under the Paris Convention and provisions of national law in a designated State, the entire contents of which are hereby incorporated by reference.

EXPLANATION OF SYMBOLS

T1, T2, T3, T4, T5, T6, T7: Transistor
C1, C2: Capacitor
OLED: Organic EL element
scan[n−1], scan[n], scan[n+1]: Scanning line
Vini[n]: Initiating voltage line
em[n]: Light-emission control line
ELVDD, ELVSS: Power supply line
data, data_2: Signal line
adj [n]: Voltage adjusting line
A: Opening
B: Display area
1: Data driver
2: Scan driver
3: Data signal transducer
100: Substrate
101: Semiconductor layer
102: Gate electrode
103: Pixel electrode (Anode)
110, 111, 112: Interlayer insulating film
113: Edge cover

The invention claimed is:

1. An analog gradation-driving active matrix substrate, comprising:

pixels each including a current-driven light-emitting element and a drive transistor, the current-driven light-emitting element has a pixel electrode electrically coupled with the drive transistor, the drive transistor supplies a current to the current-driven light-emitting element through the pixel electrode, wherein an adjusting transistor for adjusting a voltage of the pixel electrode is electrically connected to a path for the electric current supplied from the drive transistor to the current-driven light-emitting element; and a first signal line to which a source electrode or a drain electrode of the adjusting transistor is electrically connected is different from a second signal line to which a source electrode or a drain electrode of the drive transistor is electrically connected, wherein a first voltage of the first signal line is lower than a second voltage of the second signal line by a threshold voltage of the drive transistor, the first voltage is applied to the source electrode or the drain electrode of the adjusting transistor, and the second voltage is applied to the source electrode or the drain electrode of the drive transistor.

2. The active matrix substrate according to claim 1, wherein a gate electrode of the drive transistor is provided in a wiring layer which is disposed directly below the pixel electrode.

3. The active matrix substrate according to claim 1, wherein the pixel further includes a compensation circuit for compensating variation of a threshold voltage of the drive transistor.

4. A display device, comprising the active matrix substrate according to claim 1, the display device allowing the current-driven light-emitting element to emit light after voltage adjustment of the pixel electrode by the adjusting transistor.

5. The display device according to claim 4, wherein the voltage adjustment and the light emission are sequentially performed.

6. An organic EL display device, comprising the active matrix substrate according to claim 1, the current-driven light-emitting element being an organic EL element, the pixel electrode being an anode or a cathode of the organic EL element.

* * * * *